United States Patent [19]

Linde et al.

[11] 4,058,925

[45] Nov. 22, 1977

[54] CONCEPTS OF REMINGTON SUPER TRAP CHOKE

[75] Inventors: John P. Linde, Richfield Springs; Douglas E. Bullis, Ilion, both of N.Y.

[73] Assignee: Remington Arms Company, Inc., Bridgeport, Conn.

[21] Appl. No.: 719,406

[22] Filed: Sept. 1, 1976

[51] Int. Cl.[2] ..... F41C 21/18

[52] U.S. Cl. ..... 42/79; 29/1.1

[58] Field of Search ..... 42/79, 76 R, 77; 29/1.1, 1.11

[56] References Cited

U.S. PATENT DOCUMENTS

| | | | |
|---|---|---|---|
| 797,345 | 8/1905 | Cokeroft | 42/79 |
| 833,484 | 10/1906 | Robedee | 42/79 |
| 863,431 | 8/1907 | Parker | 42/79 |
| 1,455,661 | 5/1923 | Rhinehart | 42/79 |
| 1,773,260 | 8/1930 | Cutts | 42/79 |
| 2,398,298 | 4/1946 | Finlay et al. | 42/79 |
| 2,466,400 | 4/1949 | Ennis | 42/79 |
| 2,700,839 | 2/1955 | Finlay et al. | 42/79 |

*Primary Examiner*—Charles T. Jordan

*Attorney, Agent, or Firm*—John H. Lewis, Jr.; Nicholas Skovran; William L. Ericson

[57] ABSTRACT

A pattern control system for a shotgun and the method of making the system in which one or more choke attachments are detachably mounted on the muzzle end of the shotgun barrel and the barrel bore and one or more progressively reduced choke constrictions, either in the bore and the choke attachments or in the attachments alone, are formed at the same time in order to eliminate tolerance buildup between the choke attachment bore constrictions and the barrel bore. By adding or deleting choke attachments, it is possible to achieve the choke constriction which will provide the desired pattern pellet density at the selected distance from the muzzle of the shotgun.

6 Claims, 6 Drawing Figures

CONCEPTS OF REMINGTON SUPER TRAP CHOKE

The present invention relates to a novel choke system for a shotgun. More particularly, the invention relates to a double or multiple choke design wherein the shot charge can be constricted in two or a number of progressive chokes as compared to the conventional choke where all the reduction is done in one constriction.

The invention further relates to a method of making the choke system wherein the bore of the barrel and the choke reduction(s) are formed in one operation, thus eliminating or at least substantially reducing manufacturing tolerances which affect the shooting performance of the shotgun.

A shotgun choke is a regulated constriction at the end of the barrel bore to control the pattern pellet density. The present chokes cover the range from no choke (cylinder bore) to full choke, which will place approximately 75% of the cartridge's pellets in a 30 inch circle at 40 yards. The standard shotgun chokes are marked as full, improved modified, modified, improved cylinder, skeet and cylinder bore. The shooter selects the shotgun with the choke which will best suit his needs; that is, he wants as big a pattern as possible to reduce aiming error but with enough pellet density that whatever he is shooting at will be hit by at least a few pellets. Therefore, all the chokes are the most effective at discrete yardage ranges. The shooter sacrifices pattern performance when he tries to use a given choke at all yardages. An example would be the improved modified choke, ideal at 16 yard trap, but marginal at the 27 yard line. The full choke (maximum constriction) would be better at the 27 yard line to give enough pellet density to consistently break targets.

The choke tube devices presently on the market are manufactured separate from the shotgun barrel to tolerances which ensure they will fit together with the threaded counterbore in the barrel or if preferred, with a threaded end portion on the outside of the barrel, i.e. similar to the familiar "Poly Choke" attachments.

There are a number of tolerances that can affect the performance of the existing choke tube devices: (1) angularity of thread in the counterbore to the barrel bore; (2) angularity of the outside diameter of the tube to the inside diameter of the tube; (3) tolerances of thread pitch diameter (class of fit) on both parts; (4) concentricity of bore to counterbore in barrel; (5) concentricity of outside diameter of tube to inside diameter of tube; (6) diameter of bore; and (7) diameter of choke in tube. Further discussion of the tolerance buildup is found below.

The idea of providing a choke attachment or choke tube to the muzzle end of a shotgun is old and well known. Representative patents are U.S. Pat. No. 797,345 issued to F. H. Cokeroft on Aug. 15, 1905; U.S. Pat. No. 1,455,661 issued to E. L. Rhinehart on May 15, 1923; and U.S. Pat. No. 2,700,839 issued to W. L. Finlay et al on Feb. 1, 1955.

It is an object of the present invention to provide a pattern control system which takes the manufacturing errors out of choke tube performance.

It is another object of the invention to provide a double or multiple choke design in which the shot charge can be constricted in two or more progressive chokes.

It is yet another object of the invention to provide a pattern control system designed to use a number of detachably mounted, progressively reduced choke tubes with a single shotgun barrel so that by selectively mounting in series or removing said detachable choke tubes, a shooter can use one gun barrel and choose an effective choke from the whole range of available chokes without affecting the point of impact of the barrel.

It is still another object of the present invention to provide a method of forming the choke constriction in the barrel bore and detachable choke tubes in the same operation thereby fitting the attachments to the bore and eliminating many of the manufacturing tolerance buildups inherent in other choke tube attachments.

Other objects and advantages will become apparent from the following description taken in conjunction with the accompanying drawing in which.

Figure 1:
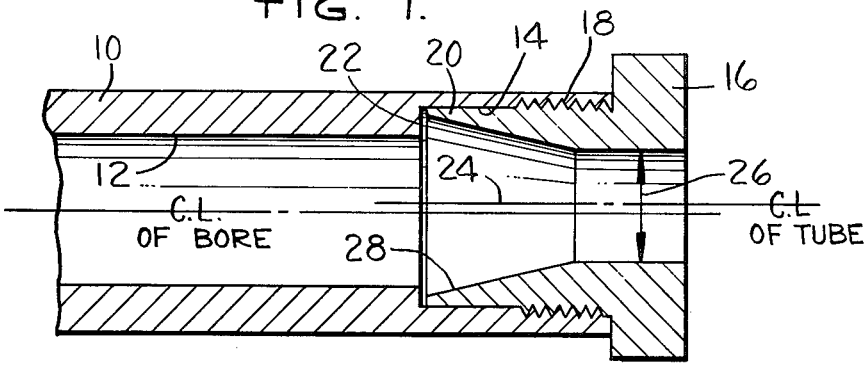
FIG. 1 is a sectional view of a portion of a shotgun and a presently used choke attachment mounted thereon and shown out of alignment therewith.
Figure 2:
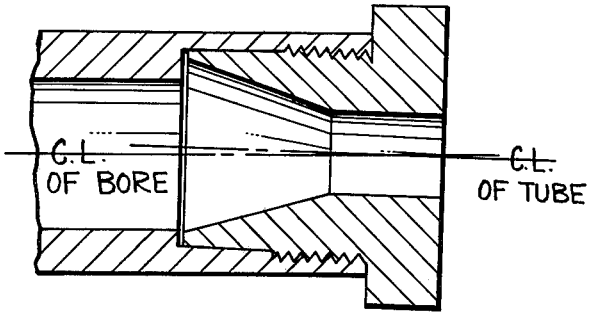
FIG. 2 is similar to FIG. 1 but illustrates a different type of misalignment of the choke attachment relative to the barrel bore.
Figure 3:
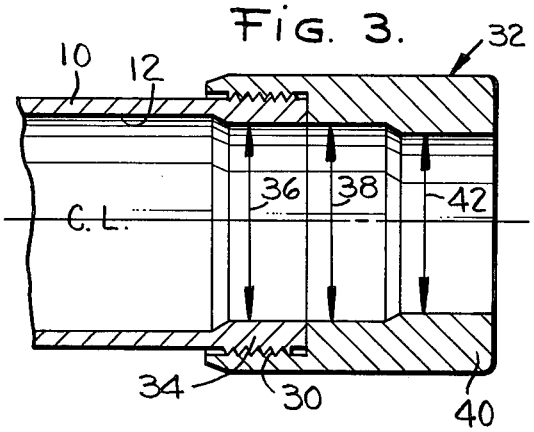
FIG. 3 is a sectional view of the end of a barrel with a choke attachment detachably mounted on the outer periphery and showing a two-step progressive choke.
Figure 4:
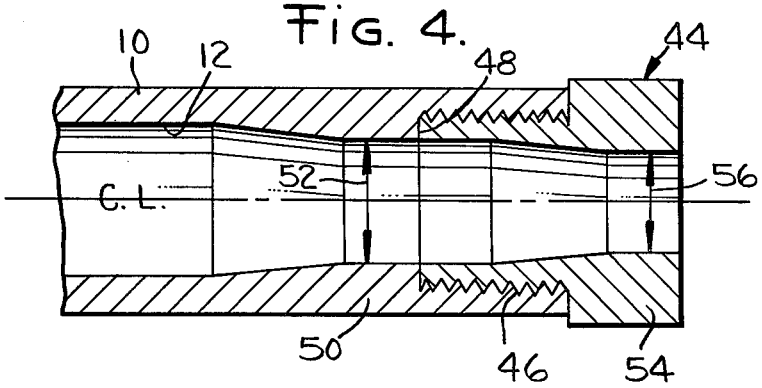
FIG. 4 is a sectional view of a two-step progressive choke similar to FIG. 3 except that the attachment is mounted on the inside diameter of the barrel.
Figure 5:
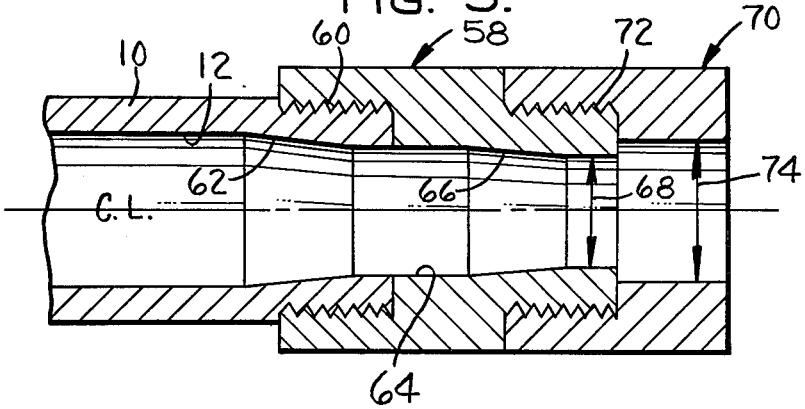
FIG. 5 is a sectional view showing another modification embodying the invention in which the barrel bore has a choke constriction, a first attachment has a progressively greater choke constriction and a second attachment has a bore of greater diameter than the diameter of the first attachment constriction.
Figure 6:
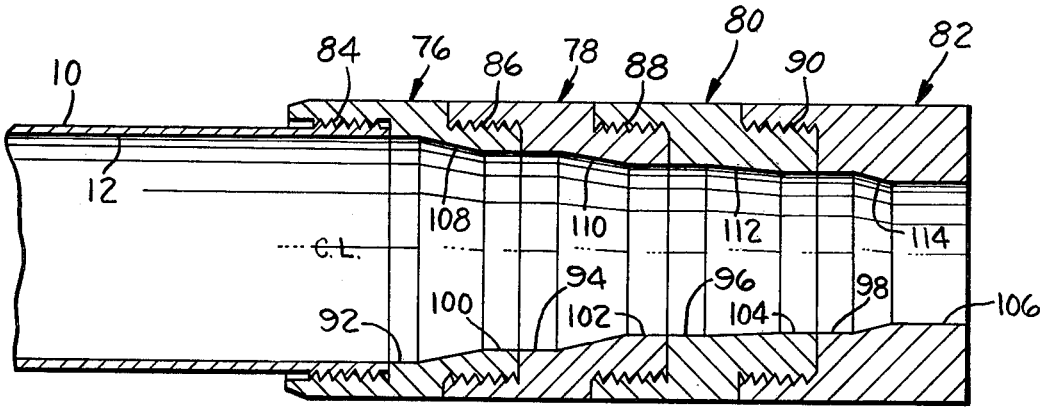
FIG. 6 is a sectional view of a barrel that does not have a choke constriction in the barrel, but that does have a number of detachably mounted choke attachments each with a progressively greater choke constriction therein.

FIGS. 1 and 2 show a prior art choking device presently on the market to illustrate some defects that may be caused by manufacturing tolerances buildup. All of the FIGURES show a barrel 10 to which is detachably mounted one or more attachments. The attachments will be identified by different reference numbers but the barrel will retain the number 10 and the barrel bore will be referenced as 12. The first attachment can be secured to the muzzle end of the barrel 10 by threads on the outer periphery of the barrel (as shown in FIGS. 3, 5, and 6) or by threads on the periphery of the bore 12 (as shown in FIGS. 1, 2, and 4).

FIGS. 1 and 2 show a barrel 10 with a constant-diameter bore 12 and a counterbore 14 at the mouth end of the barrel having a larger diameter than the bore 12. A choke tube attachment 16 is secured in the counterbore 14 by thread means 18 so that when tightened, the rear end 20 of the choke tube stops just short of an abutment 22 in the counterbore. The choke tube 16 has an axially-extending bore 24 which is constricted or reduced in diameter from its maximum diameter at its rear end (adjacent the barrel bore) to its minimum choke diameter 26 at its forward of muzzle end. An inclined or tapered surface 28 gradually reduces the area through which shot pellets (not shown) must pass. The relationship of the minimum or choke diameter 26 with the bore diameter determines the pattern density of the shot pellets.

When it is desired to change the pattern performance or pattern density, e.g. from a full choke to a modified choke, a shooter with a choke device as shown in FIGS. 1 and 2 would unscrew one choke tube attachment and replace it with another choke tube having a different choke diameter.

The various tolerances which can contribute to tolerance buildup to affect the pattern performance are mentioned above. Because of the tolerance buildup, the point of impact can change with each choke tube and the pattern can vary considerably from what is specified on the tube. The pattern percent is governed by the amount of constriction in the choke; that is, the difference between the bore and choke tube inside diameters. If each part, i.e. barrel bore and choke tube, is machined separately, and as an example, if we assume a bore tolerance total of 0.006 inch and a choke tube inside diameter tolerance total of 0.004 inch, then the amount of constriction can vary 0.010 inch, which is 25% of the total full choke constriction and 50% of the normal modified choke constriction. See FIG. 1.

The point of impact can be affected if the choke tube does not line up with the barrel bore. This condition can be caused by angularity in the choke tube, outside diameter to inside diameter, angularity in the counterbore in the barrel with the barrel bore (see FIG. 2), concentricity of the bore center line to the choke tube center line (see FIG. 1), and the concentricity and angularity can also be affected by the thread fit of the choke tube to the barrel.

The point of impact can vary when choke tubes are interchanged with these tolerance considerations. The point of impact can also vary depending on how tight the choke tube is screwed in or on the barrel.

The pattern can also be affected by pronounced angularity as it will tend to flatten, that is, to cause the shot pattern to be noncircular. It can also give patterns which are not uniformly distributed with pellets. If every part is made perfect (to no tolerance), a separable choke tube could duplicate a standard choke (where the constriction is in the bore of the barrel only). However, tolerance free manufacturing is not as yet a fact of life.

The shooter who uses the choke devices shown in FIGS. 1 and 2 is sacrificing point of impact and pattern performance to try to control his pellet density at a given yardage. That is, he is using his gun to shoot at more than one yardage range and considers pellet density more important than pattern performance and point of impact. Pattern performance includes not only the pellet density in a 30 inch circle but the distribution of the pellets. Pellet distribution is important because a shooter does not want a pattern with holes or areas where few or no pellets are hitting. These holes or open areas in pattern distribution can cause a shooter to miss his target, whether an inanimate clay target or a flying bird.

The present invention is shown in the embodiments illustrated in FIGS. 3–6. The choke tubes of these embodiments are similar in appearance to existing choke tubes and can be threaded to the outside or inside of the barrel.

FIG. 3 illustrates a typical embodiment where the barrel 10 has a bore 12 and a thread means 30 on the outer periphery thereof to which a choke tube 32 is threaded. The muzzle end of the barrel 10 has a constricted or reduced portion 34 which forms a choke diameter 36. Choke tube 32 has a threaded portion which engages thread means 30 of the barrel and an inside bore diameter 38 which is the same as the barrel choke diameter 36. Choke tube 32 also has a constricted portion 40 which forms a choke diameter 42. The center line of the choke tube 32 is the same as the center line of the barrel 10, as will be explained later. With choke tube attached, as shown in FIG. 3, the choke diameter 42 determines the pattern performance of the gun. With the choke tube removed, the pattern performance of the gun will be determined by choke diameter 36, which is less than the diameter of regular bore 12 of the gun barrel.

FIG. 4 is similar to FIG. 3 except that the choke tube 44 is attached by thread means 46 to a counterbore on the inside of barrel 10. The muzzle end of barrel 10 has a constricted or reduced portion 50 which forms a choke diameter 52. Choke tube has its initial diameter equal to barrel choke diameter 52 and has a further progressively greater constriction 54 which forms a choke diameter 56. The pattern performance of the barrel-choke tube of FIG. 4 is determined by choke diameter 56 of the choke tube 44 and the pattern performance of the gun with the choke tube 44 removed is determined by the barrel choke diameter 52, which again is less than the diameter of barrel bore 12.

FIG. 5 is somewhat similar to FIG. 3 in having a choke tube 58 attached to the outside of the muzzle end of barrel 10 by threaded means 60. The inclined surface 62 leading from the barrel bore 12 to the bore 64 of the choke tube 58 is more gradual than FIG. 3. An inclined surface 66 in the choke tube 58 gradually reduces the diameter of the bore 64 to the choke diameter 68. A second attachment 70 is shown attached by thread means 72 to the outside surface of the muzzle end of choke tube 58. Attachment 70 does not affect the pattern performance and is used for balancing the weight of the firearm to permit shooters to have the "feel" for the gun which is comfortable to them.

FIG. 6 shows an embodiment which differs from the previous figures in that there is no constriction or reduction in the barrel bore 12. The multi-step choke construction is effected in the choke tube attachments. FIG. 6 shows four choke tube attachments 76, 78, 80 and 82 although obviously there could be as few as two and more than four if desired. Each of the choke tube attachments 76, 78, 80 and 82 respectively are similar in having threaded means 84, 86, 88 and 90 respectively by which the choke tubes are attached to the outside of the barrel 10 and subsequently to the previously mounted choke tube. Each choke tube also has a bore 92, 94, 96 and 98 respectively which is equal to the final bore diameter of the barrel bore 12 and subsequently to the choke diameters 100, 102, and 104 respectively of the previously mounted choke tube. The bores 92, 94, 96 and 98 taper down to the choke diameters 100, 102, 104 and 106 respectively by tapered portions 108, 110, 112 and 114 respectively. As can be seen, the constriction or reduction in each of the choke tube attachments progressively become greater — and the choke diameter smaller — so that by removing the forward choke tube, the gun will have a larger choke diameter to determine the pattern performance of the shot pellets.

As mentioned above, the present invention contemplates taking the manufacturing errors out of choke tube performance. The process works with or without putting the choke in the end of the barrel. This is accomplished by machining the tube bore to final dimensions at the same time the shotgun bore is being finished. The pattern performance is not compromised by the progressive stepped choke. In manufacturing, the final cutter which cuts the barrel bore also cuts the choke configuration(s) in the attached choke tube(s). The choke tube with an unfinished bore is connected to the barrel, and the combined barrel-choke tube unit is bored and choked as a unit. This process eliminates the tolerance buildups between choke tube and barrel bore. By removing the choke tube and screwing on a dummy tube to maintain gun balance, the shooter would have the choke which is in the barrel, for example modified or improved modified. By putting the original choke tube back on, he would have a double choke such as full or tight, full choke. Obviously, other combinations are possible, as explained above and shown in the drawing.

Each choke tube is machined to only one barrel to give perfect performance and will not give maximum performance with another barrel. With this design, the point of impact will be the same whether the choke tube attachment is on or off. Pattern percent will be easy to control as a common reamer cuts both parts together and can be ground to give the desired constriction. As mentioned above, the choke tube can be designed to thread either the inside or outside of the barrel.

What is claimed is:

1. A pattern control means for a shotgun having a barrel with a bore therein through which a shot charge is explosively propelled, said pattern control means comprising at least two separate choke means that are progressively reduced in the direction of shot movement and through which the shot charge is constricted to control the pattern pellet density at a predetermined distance from the muzzle of the shotgun barrel, at least one of the choke means comprising a choke tube attachment with inner wall surfaces formed at the same time as the shotgun bore, means detachably mounting said attachment to the end of said barrel, said attachment wall surfaces including a bore with a rear cylindrical section adjacent the end of the barrel whose diameter is essentially the same as the exit bore of the barrel muzzle, an intermediate section which tapers inwardly to form a smaller diameter bore, and a forward cylindrical section, having a diameter essentially the same as the smaller diameter bore of the intermediate section.

2. A pattern control means as recited in claim 1 wherein said progressively reduced chokes comprise a first choke reduction located in the bore at the muzzle end of said barrel and an additional choke reduction is provided in each of a plurality of choke tubes separably and detachably mounted in series on said choke tube attachment, said additional choke reductions increasing progressively in each choke tube so that the last choke attachment has the greatest choke reduction, and the effective choke of the shotgun being adjustable merely by removing one or more choke tubes.

3. A method of making a progressive stepped choke for a shotgun that can be modified to provide a plurality of effective choke constrictions without affecting the point of impact of the shotgun, comprising:

1. Forming an elongated barrel with an unfinished bore therein;
2. mounting a choke tube attachment with an unfinished bore to the muzzle end of said barrel so as to be detachable therefrom without damaging said barrel; and
3. working said barrel bore to finished dimensions while at the same time forming a first choke configuration in said barrel bore and a more constricted second choke configuration in the bore of said detachably mounted choke tube attachment so as to eliminate tolerance buildups between the choke tube attachment bore and the shotgun barrel bore.

4. A method of making a progressive stepped choke as recited in claim 3 where at least one additional choke tube attachment with an unfinished bore is detachably mounted on said barrel-mounted choke tube attachment, said additional choke tube attachment being worked at the same time as said first and second choke configurations to form a third choke confirugation which is progressively more constricted in the direction of shot movement, the forming of said choke configurations at the same time resulting in said barrel bore and said choke bores being in alignment so as to eliminate tolerance buildups in the various bores.

5. A method of making a progressive stepped choke for a shotgun that can be modified to provide a plurality of effective choke constrictions without affecting the point of impact of the shotgun comprising:

1. Forming an elongated barrel with an unfinished bore therein;
2. detachably mounting at least two choke attachments with unfinished bores to said unfinished barrel, the first of said choke attachments being detachably mounted to the muzzle end of said barrel and the second of said choke attachments being detachably mounted to said first choke attachment; and
3. working said barrel bore to its finished, constant diameter dimension while at the same time forming a first choke configuration in said first choke attachment and a more constricted choke configuration in said second choke attachment.

6. A method of making a progressive stepped choke for a shotgun as recited in claim 5 wherein any additional choke attachments are detachably mounted to the preceding choke attachment and the choke configuration formed therein is progressively more constricted in the direction of shot movement.

* * * * *